US006688694B1

(12) United States Patent
Yu

(10) Patent No.: US 6,688,694 B1
(45) Date of Patent: Feb. 10, 2004

(54) RELEASABLE SAFETY DEVICE FOR A CHAIR BACKREST

(76) Inventor: Wei-mei Yu, 3F1.-3, No. 20, Junghua Rd., Sanshia Jen, Taipei, Taiwan (TW)

( * ) Notice: Subject to any disclaimer, the term of this patent is extended or adjusted under 35 U.S.C. 154(b) by 0 days.

(21) Appl. No.: 10/226,973

(22) Filed: Aug. 22, 2002

(51) Int. Cl.[7] ..... B60N 2/02

(52) U.S. Cl. ..... 297/362.13; 297/376; 297/354.13

(58) Field of Search ..... 297/362.13, 376, 297/301.5, 301.6, 301.7, 302.5, 302.6, 302.7, 354.13

(56) References Cited

U.S. PATENT DOCUMENTS 3,024,067 A * 3/1962 Brandoli
3,744,844 A * 7/1973 Nomaki et al.
3,784,252 A * 1/1974 Peterson
3,807,796 A * 4/1974 Wirges
5,222,783 A * 6/1993 Lai
5,568,961 A * 10/1996 Colasanti

* cited by examiner

*Primary Examiner*—Milton Nelson, Jr.
(74) *Attorney, Agent, or Firm*—Pro-Techtor Inter-national Services

(57) ABSTRACT

A chair comprises a seat frame and a backrest frame. A first connecting member is provided on each of two lateral sides of the seat frame. A second connecting member is provided on each of two lateral sides of the backrest frame. Each second connecting member is pivotally connected with an associated first connecting member. The inclination angle of the backrest frame relative to said seat frame is adjustable. A safety device includes a frame fixed to one of the second connecting member and a pin extending through the frame and including an end located on a path of the associated first connecting member, thereby restraining a maximum inclination angle of the backrest frame relative to the seat frame. The safety pin is movable away from the path of the associated first connecting member, allowing the backrest frame to be moved to a position aligned with the seat frame.

8 Claims, 12 Drawing Sheets

RELEASABLE SAFETY DEVICE FOR A CHAIR BACKREST

BACKGROUND OF THE INVENTION

1. Field of the Invention

The present invention relates to a releasable safety device for a chair backrest. In particular, the present invention relates to a safety device that limits an inclination angle of a chair backrest, wherein the safety device can be released for transport purpose.

2. Description of the Related Art

FIG. 1 of the drawings illustrates a seat frame 10 and a backrest frame 11 for a chair of a conventional design. The seat frame 10 and the backrest frame 11 are connected together by hinges 12. Further, a stepless pneumatic positioning cylinder 13 is provided for actuating the backrest frame 11 to a desired inclined position relative to the seat frame 10 under control of a control rod 14. At least one extension 15 extends from the backrest frame 11 for limiting the inclination angle of the backrest frame 11 to be about 125 degrees, as indicated by the phantom lines in FIG. 1. This avoids falling of the user resulting from over inclination of the backrest 11. However, this safety design results in an inconvenience to transport. In particular, the leg assembly of the chair is detached from the seat for transport, but the backrest frame 11 could not be moved to a position aligned with the seat frame 10, thereby occupying a considerable space that incurs additional cost for transport.

SUMMARY OF THE INVENTION

An object of the present invention is to provide a safety device that limits an inclination angle of a chair backrest, wherein the safety device can be released for transport purpose.

A chair in accordance with the present invention comprises a seat frame and a backrest frame. A first connecting member is provided on each of two lateral sides of the seat frame. A second connecting member is provided on each of two lateral sides of the backrest frame. Each second connecting member is pivotally connected with an associated first connecting member. The inclination angle of the backrest frame relative to said seat frame is adjustable. A safety device includes a frame fixed to one of the second connecting member and a pin extending through the frame and including an end located on a path of the associated first connecting member, thereby restraining a maximum inclination angle of the backrest frame relative to the seat frame. The safety pin is movable away from the path of the associated first connecting member, allowing the backrest frame to be moved to a position aligned with the seat frame.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
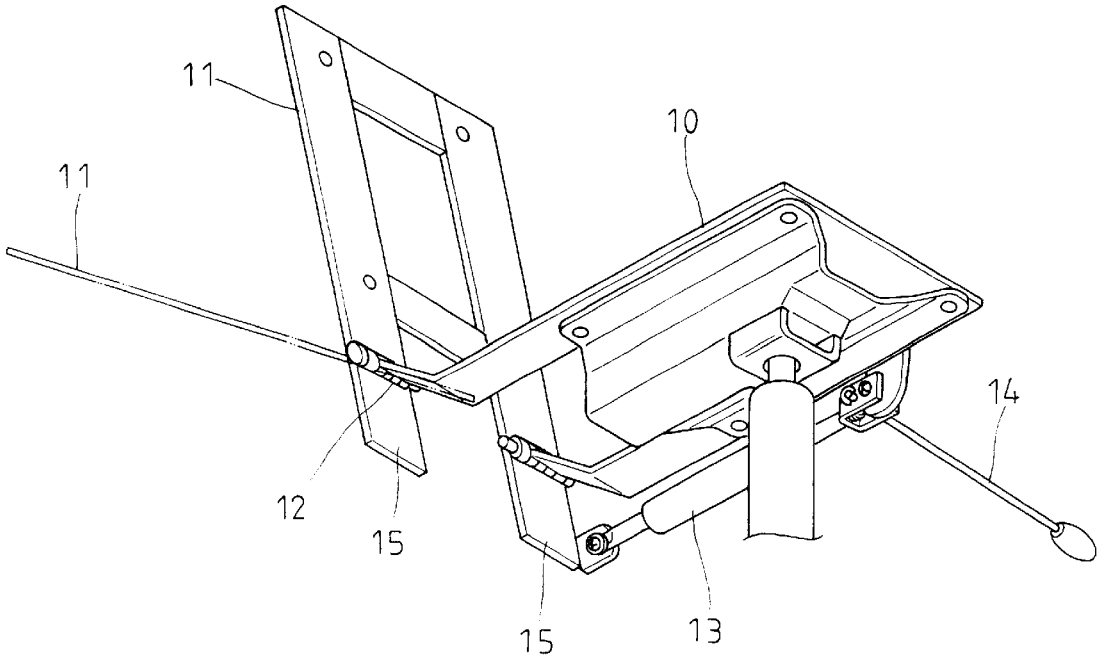
FIG. 1 PRIOR ART
FIG. 1 is a perspective view of a seat frame and a backrest frame for a chair of a conventional design.
Figure 2:
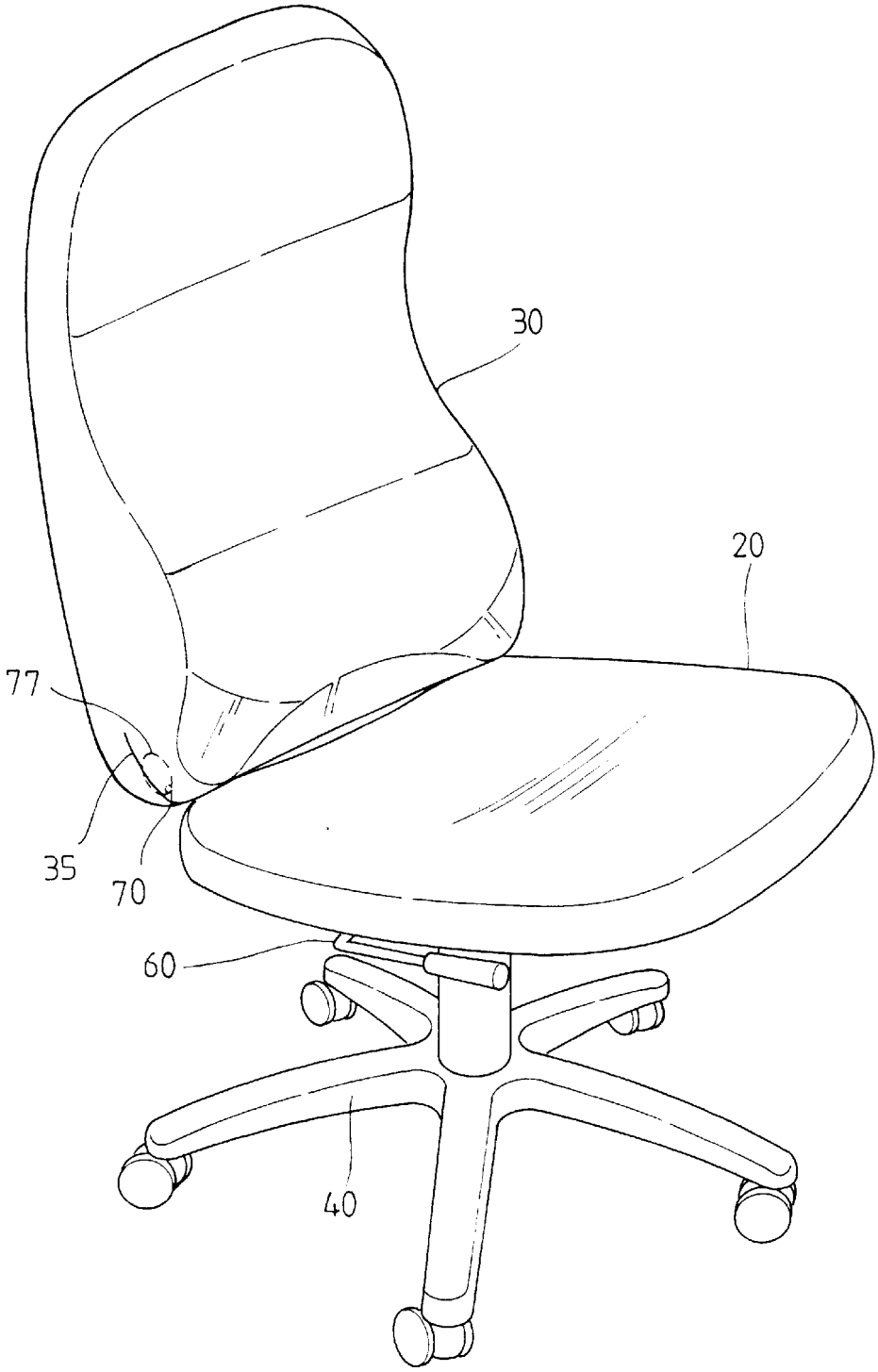
FIG. 2 is a perspective view of a chair with a releasable safety device in accordance with the present invention.
Figure 3:
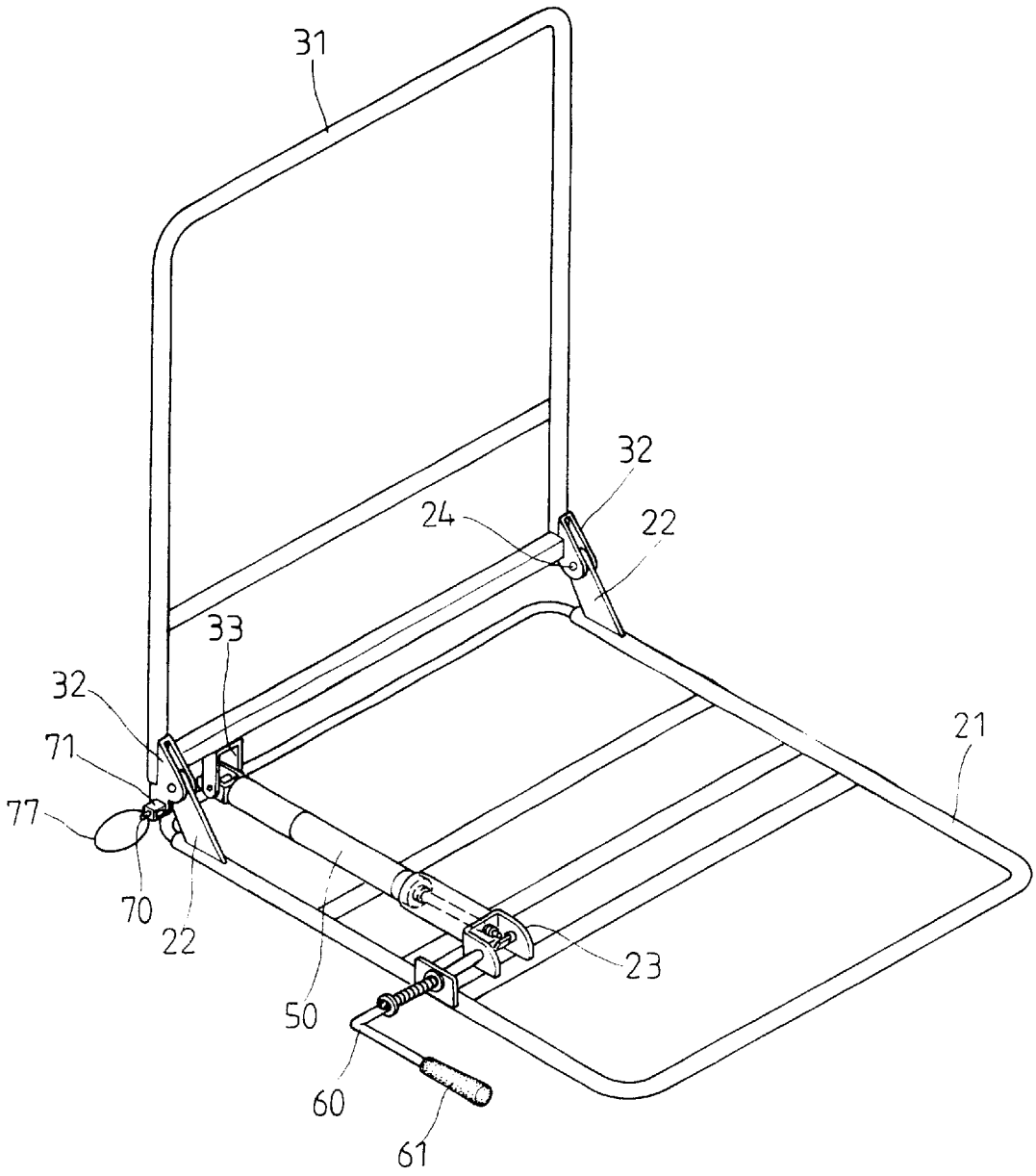
FIG. 3 is an exploded perspective view of a seat frame, a backrest frame, and the releasable safety device of the chair in accordance with the present invention.

Referring to FIGS. 2 and 3, a chair in accordance with the present invention generally comprises a seat frame 21 for carrying a seat 20, a backrest frame 31 for carrying a backrest 30, and a leg assembly 40 detachably attached to the seat frame 21. The seat frame 21 includes two first connecting members 22 respectively provided on two lateral sides thereof. The backrest frame 31 includes two second connecting members 32 respectively provided on two lateral sides thereof. Each first connecting member 22 is pivotally connected to an associated second connecting member 32 by a pivot axle 24. In this embodiment, each second connecting member 32 is a substantially U-shaped member for pivotally receiving an end of the associated first connecting member 22.

A stepless pneumatic positioning cylinder 50 is mounted between the seat frame 21 and the backrest frame 31 for adjusting inclination angle of the backrest frame 31 relative to the seat frame 21 under control of a control rod 60 having a grip 61 on an end thereof.

Figure 4:
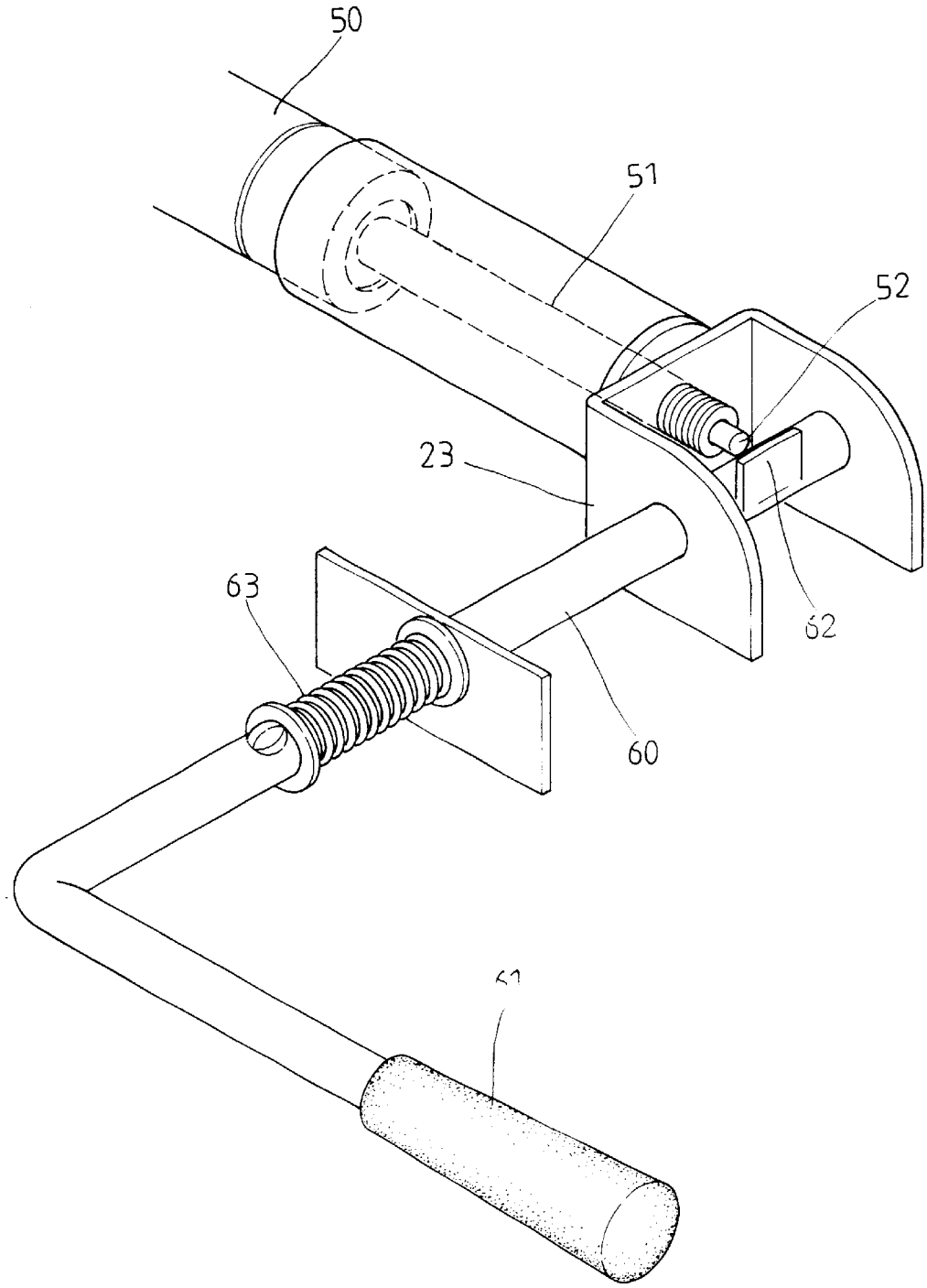
FIG. 4 is an enlarged partial perspective view of a control rod and an end a stepless pneumatic positioning cylinder of the chair in accordance with the present invention.

The stepless pneumatic positioning cylinder 50 includes a piston rod 51 (FIG. 4) that is extended to its outermost position when the backrest frame 31 is in an upright position, i.e., the backrest frame 31 is at an angle of 90 degrees relative to the seat frame 21. The piston rod 51 is attached to a support base 23 (FIG. 3) fixed to the seat frame 21. A stem 52 (FIG. 4) of a control valve (not shown) mounted in the stepless pneumatic positioning cylinder 50 has an end located in the support base 23. The other end of the control rod 60 is pivotally supported by the support base 23 and includes an actuating block 62. A torsion spring 63 is mounted around the control rod 60 such that the actuating block 62 is biased away from the stem 52 when in a normal state. Thus, the stepless pneumatic positioning cylinder 50 is not actuated when in the normal state of the control rod 60.

Figure 5:
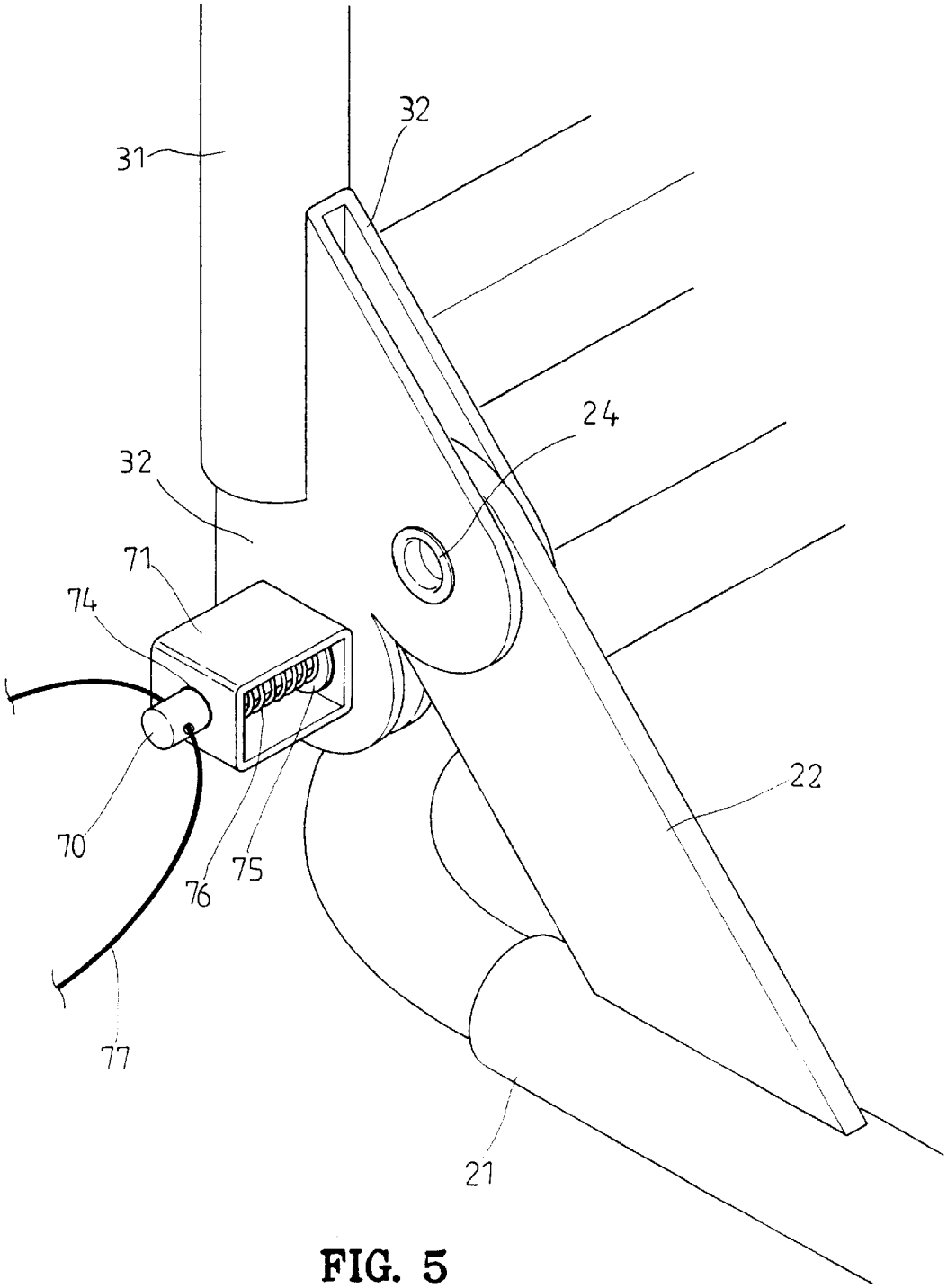
FIG. 5 is an enlarged partial perspective view illustrating the releasable safety device in accordance with the present invention.
Figure 6:
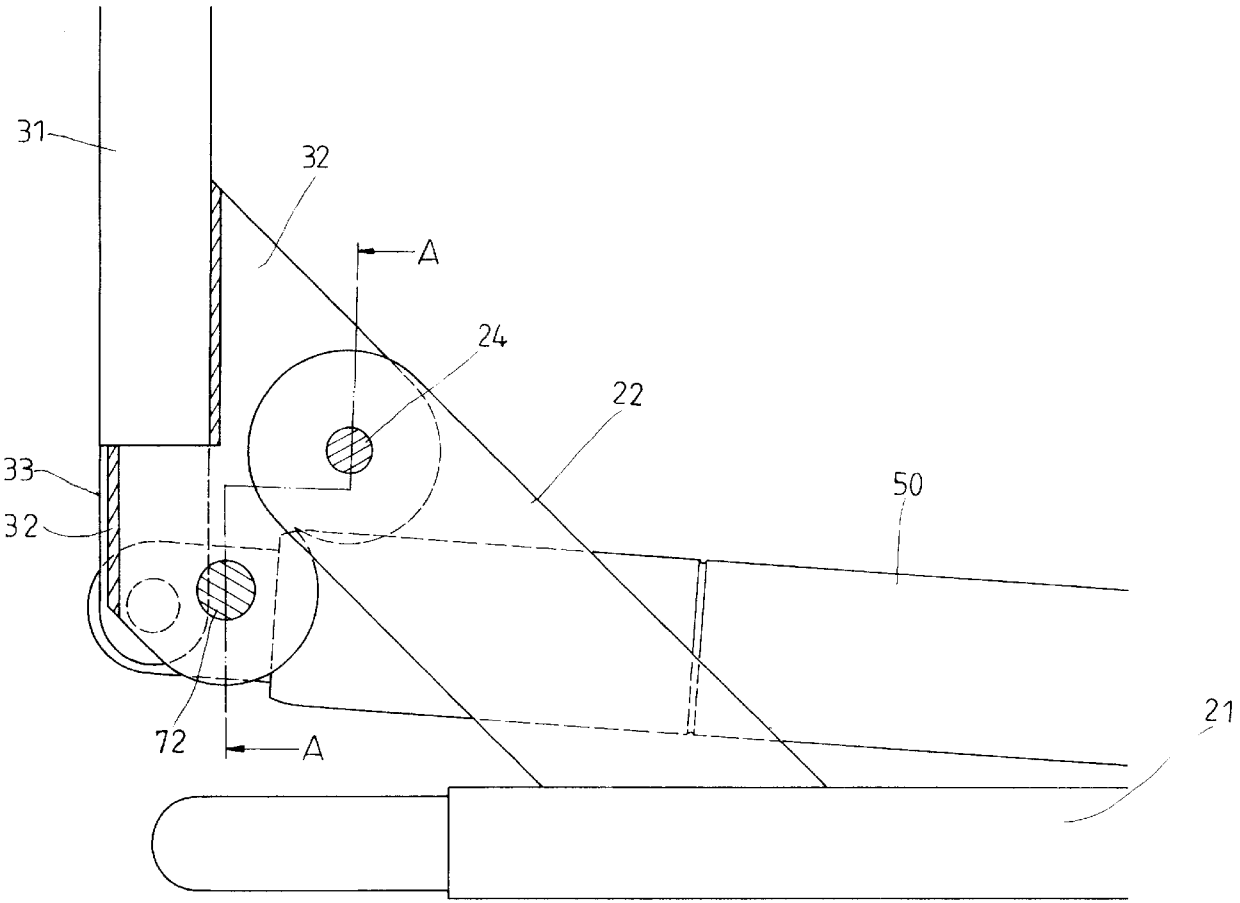
FIG. 6 is an enlarged side view, partly sectioned, of the seat frame and backrest frame of the chair in accordance with the present invention.
Figure 7:
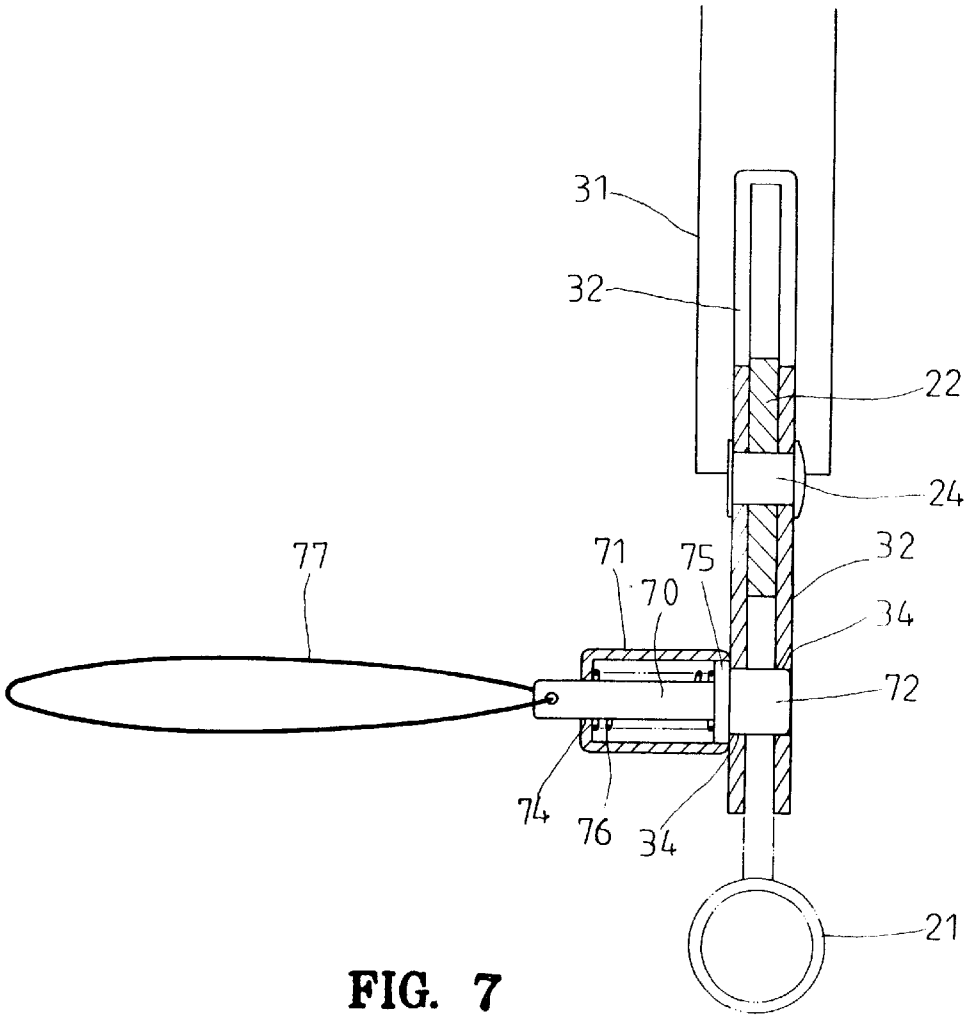
FIG. 7 is a sectional view taken along plane A—A in FIG. 6.

Referring to FIGS. 5 through 7, the chair further includes a safety device comprising a frame 71 fixed to one of the second connecting members 32 on the backrest frame 31 and located behind and below the associated pivot axle 24. The safety device further includes a safety pin 70 extending through a through-hole 74 in a side of the frame 71 and including a first end (not labeled) to which a pull string 77 is attached and a second end 72. The first end and the second end 72 of the safety pin 70 are located on both sides of the frame 71. Further, the second end 72 of the safety pin 70 is located on a path of the associated first connecting member 22. The second end 72 of the safety pin 70 may be enlarged and extended into aligned holes 34 of two sidewalls of the associated substantially U-shaped second connecting member 32. Further, a flange 75 is formed between the first end and the second end 72 of the safety pin 70, and a spring 76 is mounted around the safety pin 70 with a first end of the spring 76 being attached to the flange 75 and with a second end of the spring 76 being attached to an end wall of the frame 71.

Figure 8:
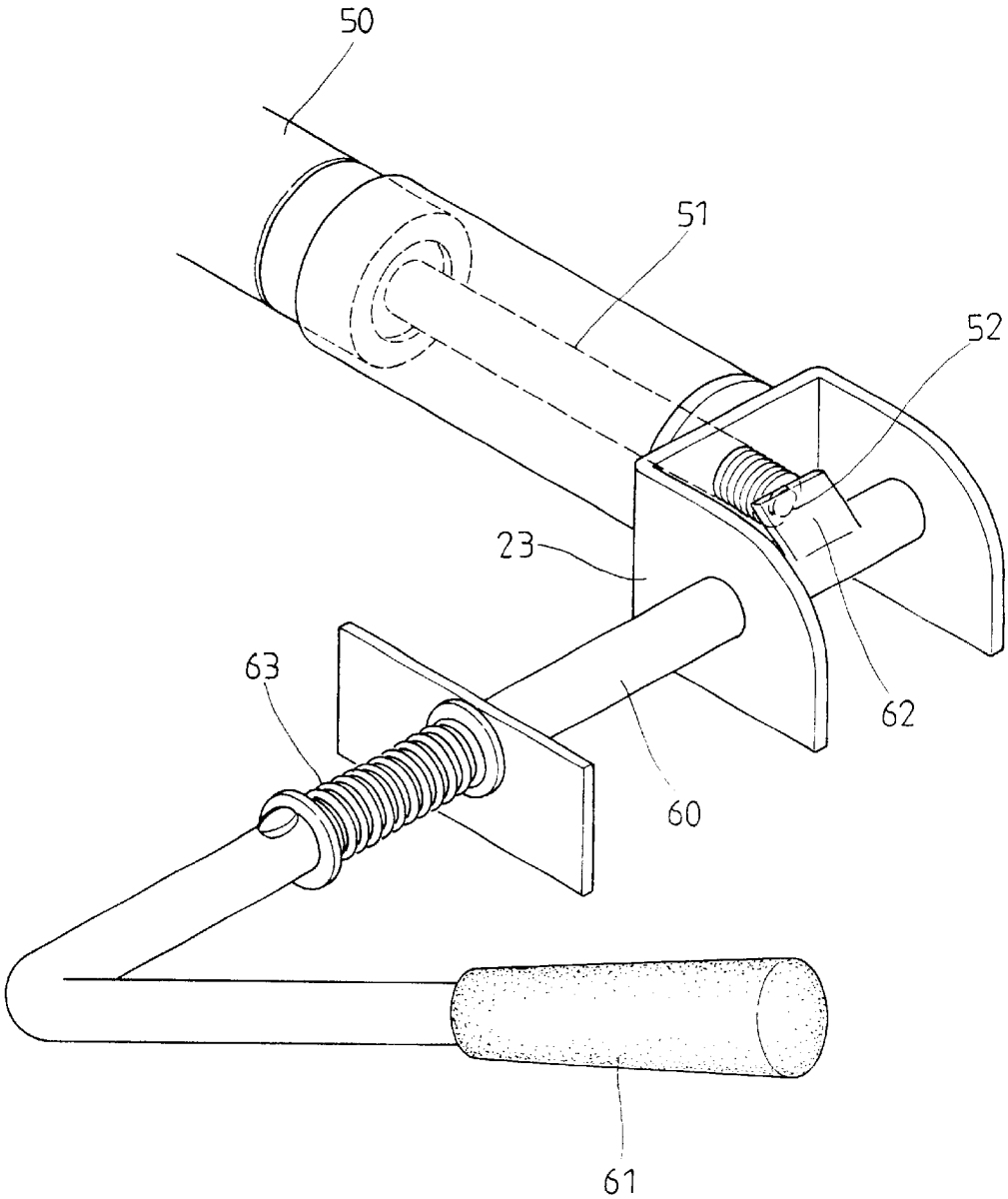
FIG. 8 is a perspective view similar to FIG. 4, illustrating operation of the control rod.
Figure 9:
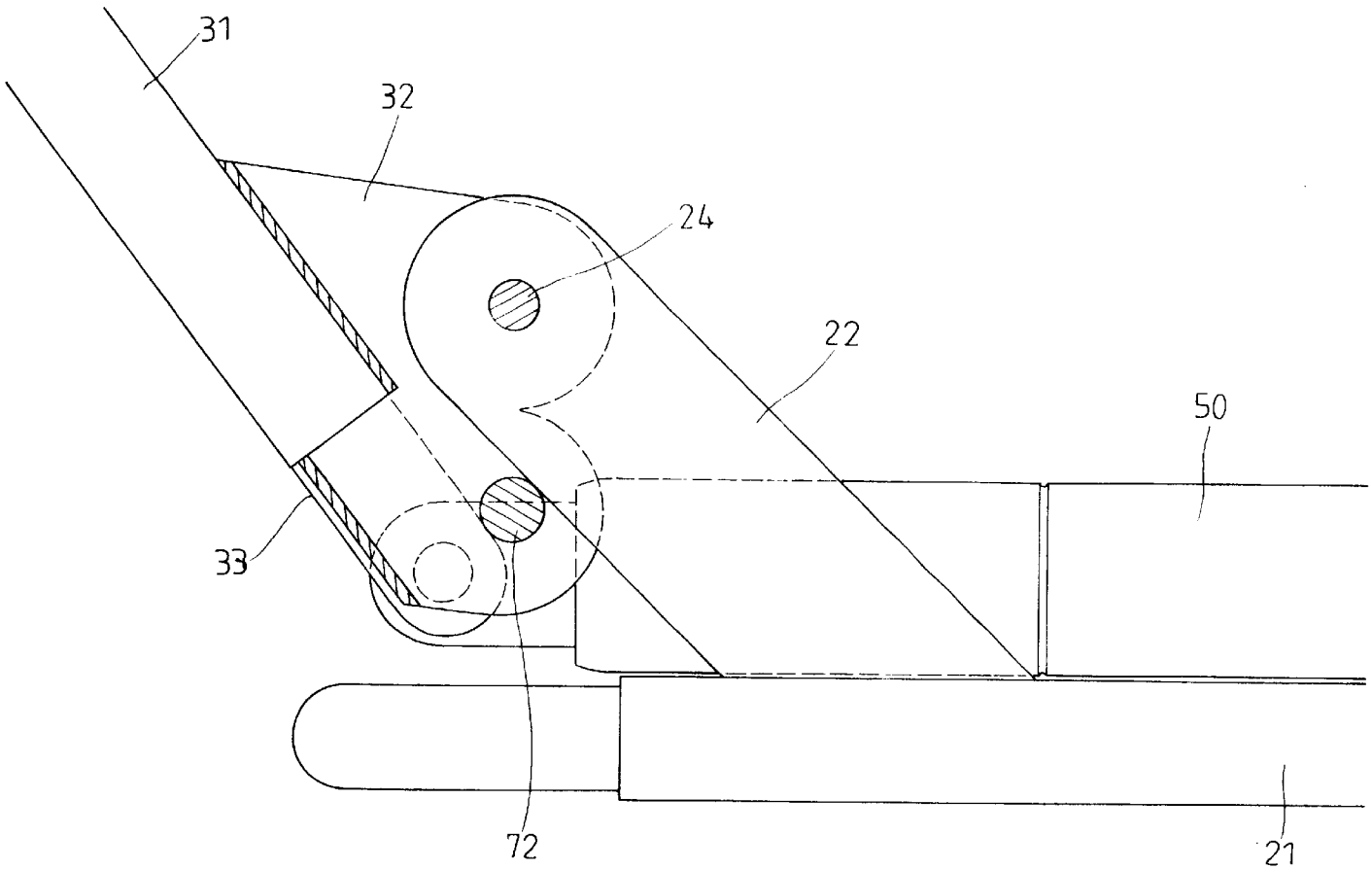
FIG. 9 is a view similar to FIG. 6, illustrating adjustment of inclination angle of the backrest frame.

In use, the user may grasp the grip 61 of the control rod 60 and move the control rod 60 to a position shown in FIG. 8. The stem 52 is actuated inward by the actuating block 62 of the control rod 60 and thus release the locking state of the stepless pneumatic positioning cylinder 50. Then, the user may lay his/her back on the backrest 31 and thus apply a force to the latter. The backrest 31 pivots away from the seat frame 21 about the pivot axles 24 until a desired inclination angle of the backrest frame 31 relative to the seat frame 21 is achieved. However, the inclination angle of the backrest frame 31 relative to the seat frame 21 is limited by the second end 72 of the safety pin 70. Namely, further pivotal movement of the backrest frame 31 away from the seat frame 21 is not allowed when the second end 72 of the safety pin 70 abuts against the associated first connecting member 22, as shown in FIG. 9. Thus, the backrest frame 31 may have a maximum safety inclination angle (e.g., 125 degrees) relative to the seat frame 21. Namely, the inclination angle of the backrest frame 31 may be in a safe range from 90 degrees to 125 degrees without the risk of falling of the user resulting from over inclination of the backrest frame 31.

Figure 10:
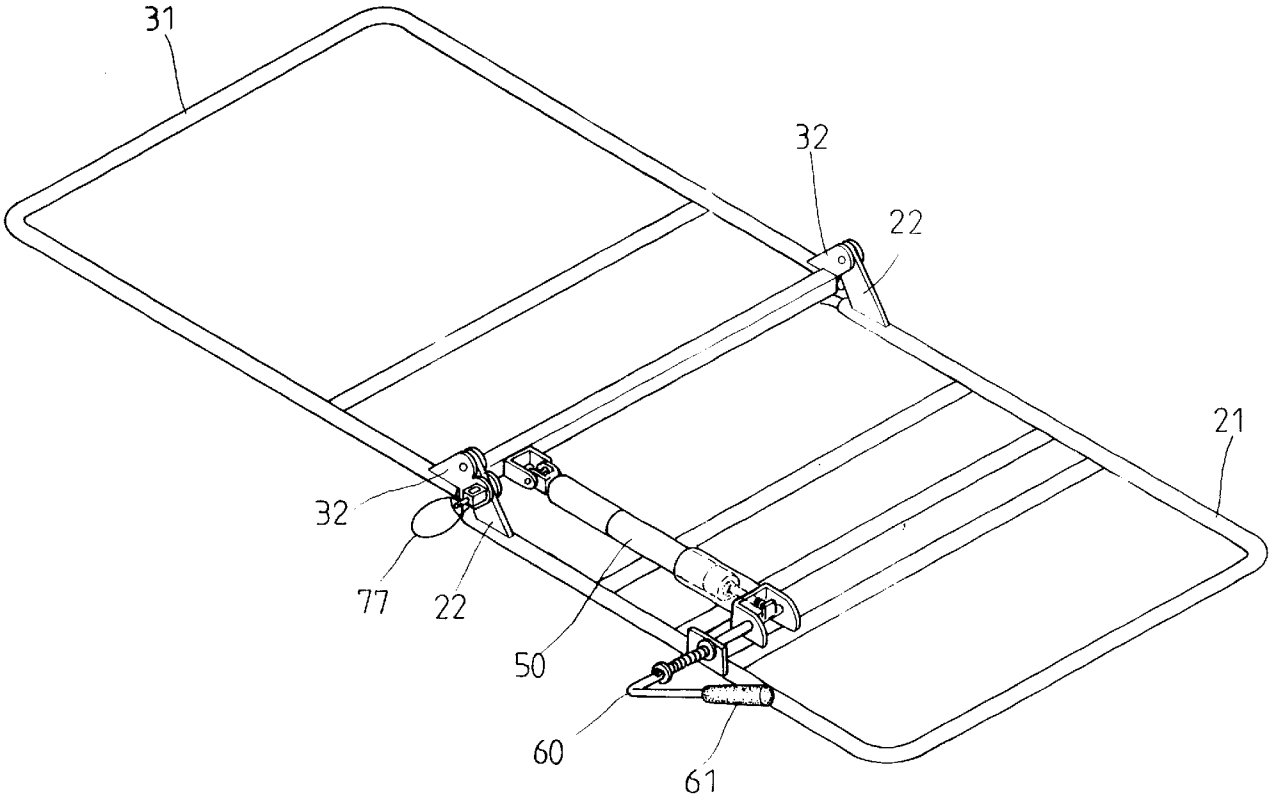
FIG. 10 is a perspective view of the seat frame and the backrest frame, wherein the backrest frame is in a position aligning with the seat frame.
Figure 11:
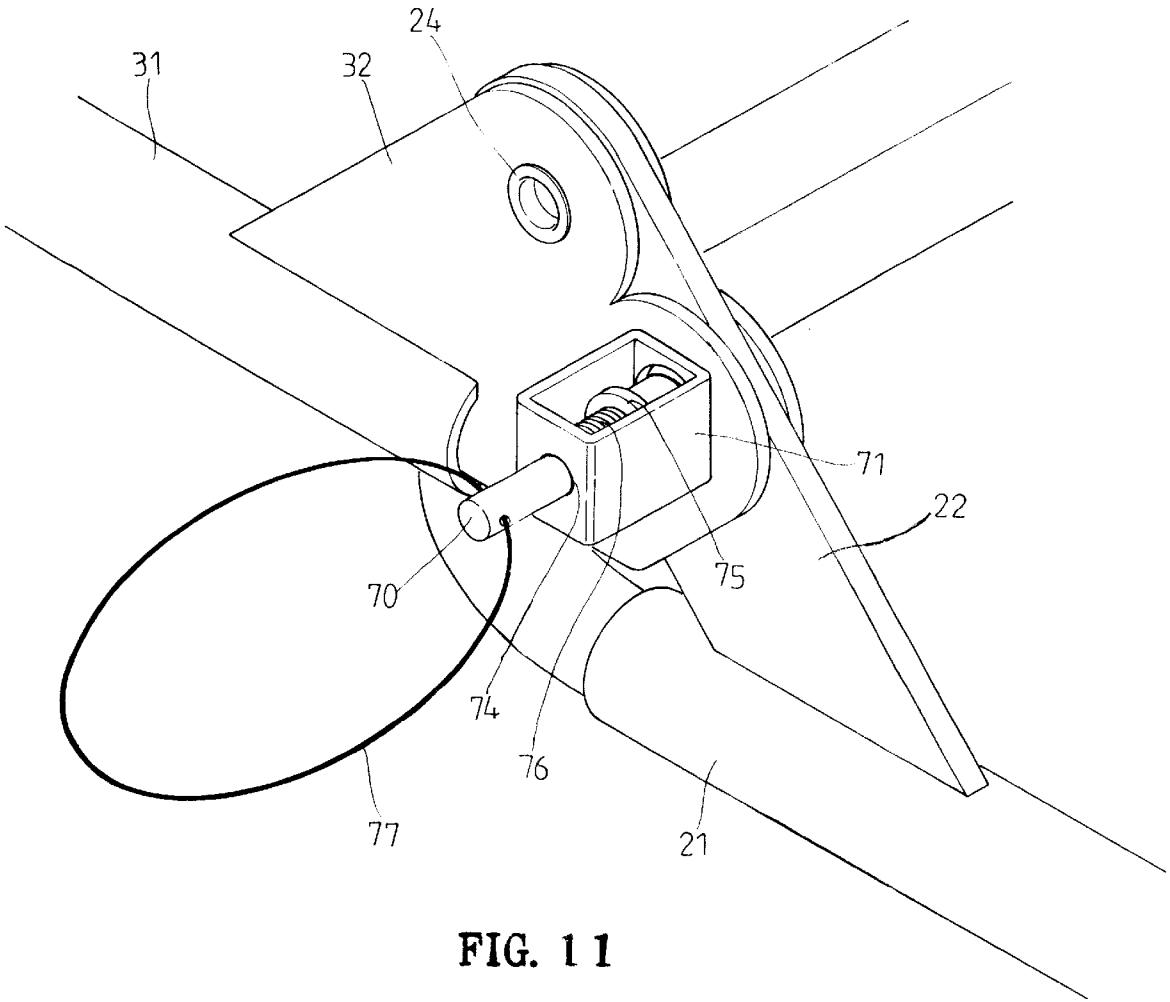
FIG. 11 is a perspective view similar to FIG. 5, wherein the backrest frame is in position aligning with the seat frame, and wherein a safety pin is in a released position.
Figure 12:
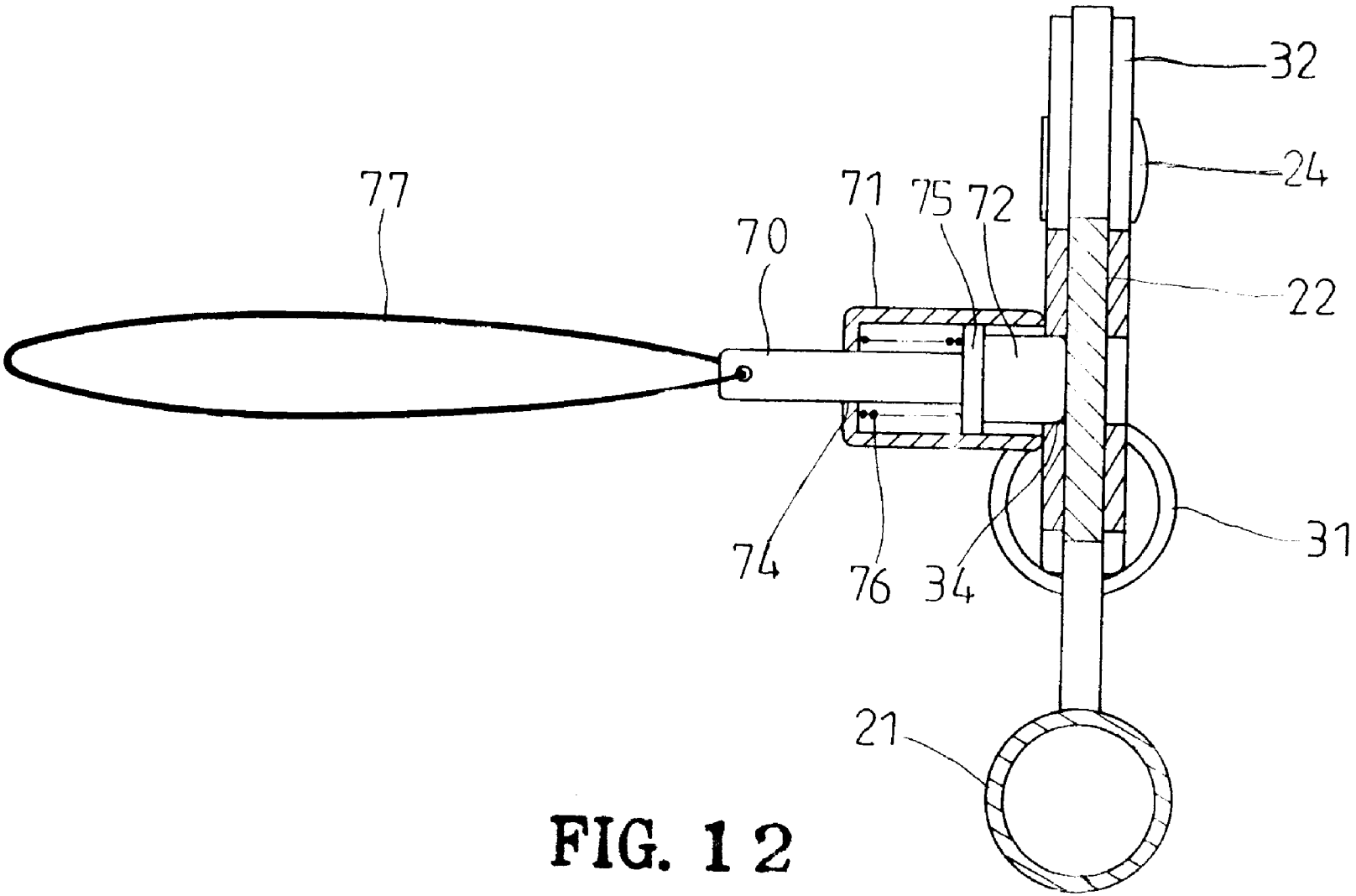
FIG. 12 is a view similar to FIG. 7, wherein the safety pin is in a released

For transport, the locking state of the stepless pneumatic positioning cylinder 50 is released by means of moving the control rod 60 to a position shown in FIG. 8. Then, the pull string 77 is pulled outward to move the second end 72 of the safety pin 70 out of the pass of the associated connecting member 22, as shown in FIG. 12. It is noted that the second end 72 of the safety pin 70 is located on an outer side of the associated second connecting member 32. Thus, the user may move the backrest frame 31 to a position aligned with the seat frame 21, best shown in FIGS. 10 through 12. Thus, the overall volume of the chair (excluding the leg assembly 4) is reduced, which is convenient and cost-saving for transport. The chair may be reconstructed after reaching the destination.

In use, the safety pin 70 is biased by the spring 76 to a position located in the path of the first connecting member 22. Referring to FIG. 2, the pull string 77 on the safety pin 70 can be hidden behind a closeable slit 35 that can be closed by a zipper or hook and loop fastener.

Although the invention has been explained in relation to its preferred embodiment, it is to be understood that many other possible modifications and variations can be made without departing from the scope of the invention as hereinafter claimed.

What is claimed is:

1. A chair comprising:

a seat frame having two lateral sides, a first connecting member being provided on each said lateral side of said seat frame;

a backrest frame having two lateral sides, a second connecting member being provided on each said lateral side of said backrest frame, each said second connecting member being pivotally connected with an associated one of said first connecting members;

means for adjusting an inclination angle of said backrest frame relative to said seat frame; and a frame fixed to one of said second connecting members, a safety pin extending through said frame and including an end located so as to block a travel path of the associated first connecting member, thereby restraining a maximum inclination angle of said backrest frame relative to said seat frame, said safety pin being movable away from said path of the associated first connecting member, allowing said backrest frame to be moved to a position aligned with said seat frame.

2. The chair as claimed in claim 1, wherein said end of said safety pin is moved to an outer side of the associated first connecting member.

3. The chair as claimed in claim 2, wherein each said second connecting member is a substantially U-shaped member including two sidewalls with aligned holes through which said end of said safety pin extends, said chair further comprising a spring mounted around said safety pin for biasing said end of said safety pin into said aligned holes of the associated second connecting member.

4. The chair as claimed in claim 3, further comprising a flange between said end of said safety pin and another end of said safety pin, said spring having a first end attached to said flange and a second end attached to an end wall of said frame.

5. The chair as claimed in claim 3, further comprising a pull string attached to another end of said safety pin.

6. The chair as claimed in claim 1, wherein each said second connecting member is a substantially U-shaped member including two sidewalls with aligned holes through which said end of said safety pin extends, said chair further comprising a spring mounted around said safety pin for biasing said end of said safety pin into said aligned holes of the associated second connecting member.

7. The chair as claimed in claim 6, further comprising a flange between said end of said safety pin and another end of said safety pin, said spring having a first end attached to said flange and a second end attached to an end wall of said frame.

8. The chair as claimed in claim 6, further comprising a pull string attached to another end of said safety pin.

* * * * *